US006105897A

United States Patent [19]

Cramer et al.

[11] Patent Number: 6,105,897

[45] Date of Patent: Aug. 22, 2000

[54] REEL WINDING ROLL AND PROCESS

[75] Inventors: Dirk Cramer, Duisburg; Ludger Goddemeier, Tönisvorst; Franz Kayser, Geldem, all of Germany

[73] Assignee: Voith Sulzer Papiertechnik Patent GmbH, Heidenheim, Germany

[21] Appl. No.: 09/275,046

[22] Filed: Mar. 24, 1999

[30] Foreign Application Priority Data

| | | | |
|---|---|---|---|
| Mar. 24, 1998 | [DE] | Germany | 198 12 723 |
| Apr. 23, 1998 | [DE] | Germany | 198 18 180 |
| Aug. 10, 1998 | [DE] | Germany | 198 36 116 |

[51] Int. Cl.[7] ..... B65H 18/14

[52] U.S. Cl. ..... 242/541; 242/564.5; 242/542.4

[58] Field of Search ..... 242/541, 542, 242/542.4, 548, 564.5

[56] References Cited

U.S. PATENT DOCUMENTS

| | | | |
|---|---|---|---|
| 3,037,557 | 6/1962 | Faeber et al. . | |
| 3,405,855 | 10/1968 | Daly et al. . | |
| 3,592,403 | 7/1971 | Schmitt et al. | 242/542.4 X |
| 3,869,095 | 3/1975 | Diltz | 242/542 X |
| 5,092,533 | 3/1992 | Gangemi | 242/542 X |
| 5,114,062 | 5/1992 | Kuhn et al. | 242/542.4 X |
| 5,582,361 | 12/1996 | Müller et al. . | |
| 5,785,273 | 7/1998 | Wolf et al. | 242/542 X |
| 5,797,559 | 8/1998 | Coffey | 242/542 X |
| 5,823,463 | 10/1998 | Fissmann et al. | 242/542.4 X |

FOREIGN PATENT DOCUMENTS

| | | |
|---|---|---|
| 2245160 | 8/1997 | Canada . |
| 683125 | 11/1995 | European Pat. Off. . |
| 2814682 | 10/1979 | Germany . |
| 2944958 | 6/1980 | Germany . |
| 87172593 | 7/1988 | Germany . |
| 3719282 | 12/1988 | Germany . |
| 3843246 | 5/1990 | Germany . |
| 19505870 | 8/1996 | Germany . |
| 19603211 | 7/1997 | Germany . |
| 59-31245 | 2/1984 | Japan . |
| 1056372 | 1/1967 | United Kingdom . |
| 2226304 | 6/1990 | United Kingdom . |

OTHER PUBLICATIONS

Patent Abstracts of Japan of JP Application No. 59 031245.

*Primary Examiner*—Donald P. Walsh
*Assistant Examiner*—Minh-Chau Pham
*Attorney, Agent, or Firm*—Greenblum & Bernstein, P.L.C.

[57] ABSTRACT

Reel winding roll that includes a core and an elastic surface layer positioned on the core. The roll also includes surface orifices formed on the elastic surface layer, air gathering spaces that are sealed at least in the circumferential direction, and channels arranged to couple the surface orifices to the air gathering spaces. The process includes guiding a moving web over a circumferential portion of the reel winding roll, and receiving, in the air gathering spaces, air entrained by the moving web. The entrained air is guided to the air gathering spaces through the surface orifices and the channels.

59 Claims, 5 Drawing Sheets

REEL WINDING ROLL AND PROCESS

CROSS-REFERENCE TO RELATED APPLICATIONS

The present application claims priority under 35 U.S.C. § 119 of German Patent Application No. 198 12 723.5 filed Mar. 24, 1998, German Patent Application No. 198 18 180.9 filed Apr. 23, 1998, and German Patent Application No. 198 36 116.5 filed Aug. 10, 1998, the disclosures of which are expressly incorporated by reference herein in their entireties.

BACKGROUND OF THE INVENTION

1. Field of the Invention

The present invention relates to a reel winding roll having an elastic surface layer on a core and a process for winding. The elastic layer has surface orifices located thereon.

2. Discussion of Background Information

A reel winding roll such as that generally discussed above is disclosed, e.g., in EP 0 683 125 A2. Orifices in the roll surface are formed as relatively short blind holes, and are used to structure the surface so that the covering can be made "softer" than the material that forms the elastic surface layer. Instead of orifices, other surface structures may also be used, e.g., encircling, spiral-shaped, or cruciform grooves or knob-like protrusions.

During the winding of a paper web, entrained air enters into the region between the reel winding roll and paper web, which generally involves a carrying or support roll. This problem increases with increasing winding speed. The greater the speed of the paper web feeding in, the more entrained air enters into the region between the roll and paper web. This entry of air results in a lifting of the web from the roll, which causes the web to drift. As a result, unclean ends are formed on the reel. Further, the contact between the paper web and the reel winding roll deteriorates, which results in problems with the transfer of torque.

This problem is well known to those ordinarily skilled in the art, and several proposed solutions have been made. For example, in DE 29 44 958 A1, a doctor knife, which is positioned to lie against the paper reel, and possibly against the paper web, is arranged to divert the entrained air from the web.

DE 38 43 246 C1 discloses placing holes through the roll jacket that open into helical or circumferential grooves. This arrangement is intended to ensure that air entering through the holes can escape again at other regions of the roll, which are not covered by the paper web.

A similar proposal is disclosed in DE 28 14 682 A1, in which the roll has channels in its elastic covering running in the circumferential direction. The circumferential grooves have an opening narrowed at a ratio of approximately 1:2 on the surface. This roll is used to dewater webs and includes an elastic covering that, when squeezed in the nip, causes the orifices to disappear. However, upstream from the nip, i.e., where the liquid appears, the orifice is open so that the water can flow off.

All these solutions are either too expensive or inadequate for reel winding. Further, these solutions cannot be used when compressed air relief of the reel is provided, i.e., when the carrying roll jacket forms one of the side seals of the pressure chamber.

SUMMARY OF THE INVENTION

The present invention reduces the risk of material web floating, even at relatively high operational speeds.

The present invention is directed a reel winding roll of the type generally discussed above that also provides that each orifice is connected via a channel with an air gathering space. The air gather space is sealed at least in the circumferential direction.

Air adhering to the material web, e.g., a paper web, can be forced into the air gathering space when the material web is placed on the winding roll. A "deviation space" with a relatively large volume, which can be filled via the channel, is provided. When the material web is raised from the roll, the air, which was forced into the air gathering space, can then escape.

Thus, a backup of air, which can result in air bubbles, is effectively avoided. The air gathering space, of course, should be of sufficient size to accommodate the air forced in with virtually no resistance. Further, since the orifices in the surface may be kept relatively small, marking of the material web can be substantially avoided. Moreover, it may be particularly advantageous to seal the air gathering space in the circumferential direction. In this way, no connections or short circuits are formed between individual orifices in the circumferential direction. Accordingly, the reel winding roll may be used to seal a winding bed in which weight relief of the winding roll is provided via compressed air. The compressed air can also be forced into the air gathering space, however, escape through connection channels, which run substantially in the circumferential direction, is not possible. Of course, the compressed air forced into the air gathering space is not available for reel relief, however, these resultant losses are relatively small. Further, because the start of placement of the material web in the instant invention occurs outside the compressed air zone, the present invention avoids problems of trying to fill the air gathering spaces with compressed air when the air gathering spaces are filled with the entrained air the material web.

It may be preferable to dimension the air gathering space as a function of the operational speed of the roll so that an increase in pressure remains less than 50 mbar. The reel winding roll has an operational speed which is determined by the desired speed of the reel winder. As a function of the operational speed, i.e., of the circumferential speed of the roll, the material web will entrain a certain amount of air on its surface. The higher the speed, the greater the quantity of entrained air and the larger the volume necessary for the air gathering space to receive the entrained air. The minimum size necessary can be relatively easily determined by simple tests.

The air gathering space may have a larger dimension than the channel arranged in the axial and/or radial direction. Thus, it is possible to provide the air gathering space with an adequate size without having to provide an excessively large cross-section of the channel or orifice size. In this manner, adequate space is available to accommodate the layer of air adhering to the material web and marking of the material web is effectively avoided.

Advantageously, a plurality of air gathering spaces may be coupled to each other substantially in the axial direction. A connection of the air gathering spaces in the axial direction does not hinder the compressed air relief of the reel because all orifices and air gathering spaces connected to each other are acted upon by the same pressure. Further, the size of the connected air gathering spaces can be increased quite significantly through "cross-wise (transverse) connection" such that, with a small structural expense, high efficiency can be obtained.

It may be preferable to arrange the orifices in a line that runs at a predefined angle relative to a line parallel to the axis. In this manner, as the roll rotates, not all orifices of a same row are simultaneously brought into contact with the material web, which yields smoother operation. Further, eccentricities are kept small or even avoided. This arrangement also contributes to a reduction in the risk of marking. However, by arranging the channels at a predefined angle to the surface, connection channels parallel to the axis can be used.

The air gathering space in operation may have a predefined minimum size. As is known, air is quite compressible. However, in order to accommodate the adhering or entrained air, a certain minimum volume is necessary. Depending upon where the air gathering space is positioned, there can be deformation of the boundary walls of this air gathering space during operation due to the prevailing stresses, e.g., the weight of the reel or the pulling power of the material web, when one or a plurality of boundary walls of the air gathering space are located in the elastic surface layer. While the elastic properties of the surface layer should not be appreciably altered by the channels and the cavities which form the air gathering spaces, relatively small deformations cannot be ruled out. Thus, according to the present invention, suitably dimensioning the air gathering space can provide that at least a predefined minimum size is retained.

It may be especially preferable for the air gathering space to have a substantially constant size during operation. Thus, pressure increases in the air gathering space can be substantially avoided even when, e.g., the air gathering spaces are located within the roll gap or nip formed between the reel forms with the reel winding roll.

The air gathering space within an insert may be preferably located radially below the surface. The insert may be designed relatively stably such that the danger of deformation of the air gathering space remains low. Although the insert does not completely guarantee that deformation will not occur, it can keep the deformation small.

The insert may be preferably formed by the core. The channels may be bored at least through the surface layer or produced in another manner. In the core, which is usually made of steel or cast iron, an adequately stable boundary wall may be provided for the cavities in which the air gathering spaces are formed.

Alternatively, the insert may be formed by a substantially axially running pipe. Further, the pipe may be positioned at a slight angle to the axial direction, and may, be embedded in the elastic surface layer.

In another alternative embodiment, the insert can be provided as a built-in part, which is positioned inside a roll shell formed by the core. Thus, the roll, as is frequently the case, may be formed as a hollow roll. An insert, which may expand elastically radially outwardly and which may have recesses running axially on its radial exterior, may be placed into the hollow roll interior. In this manner, the insert and the roll shell, which includes the core, form the cavities which accommodate the air gathering spaces.

In an advantageous embodiment, the air gathering space may be located on a boundary between two layers of material, which may facilitate production of the roll. It is possible to produce the individual air gathering spaces relatively easily during manufacture of the roll by providing them on the outside of a material, before the next material, i.e., applied radially outside of the material, is applied. For example, the air gathering spaces may be provided on the boundary between the core and the surface layer or inside a boundary between two material layers of the surface layer.

In addition to the orifices, blind holes may provided in the surface. These blind holes may only be used to collect adhering air to a limited extent. The jacket thicknesses of the reel winding roll of the present invention may not have a radial dimension sufficient to provide an adequately large air gathering space. However, these blind holes can be used to alter the elastic properties of the surface layer.

The region penetrated by orifices or a combination of orifices and blind holes may be less than approximately 15% of the entire surface, and in most cases, it is sufficient for the regions penetrated by the orifices or the combination of orifices and blind holes to be between approximately 10 and 15%. Thus, the material web and the reel may be adequately supported. Further, an adequate cross-sectional area through which the air adhering to the material web may enter is available.

Each air gathering space may be located in a chamber that is continuous in the axial direction and closed on its ends. The chamber may be subdivided by at least one partition. In this manner, it is possible to take changing reel widths into account with a simple setup of the roll. This design of the roll permits relatively simple production. Moreover, it is possible to form the chamber with a substantially axially running bore that penetrates the entire length of the roll. It is also possible to insert a substantially axially running tube in the surface covering or in the cavity of the core or to provide substantially axially running grooves between the surface layer and the surface of the core. In all cases, it may be favorable if the components surrounding the chamber run continuously in the axial direction since this simplifies production. If provision is now made that additional partitions which subdivide these chambers are provided, different reel widths may also be used with compressed air relief of the reel. In this case it is possible to limit the pressure buildup by sealing elements located along the width of the reel. Thus, an axial short circuit does not occur in this case because the connection between orifices inside the region of the winding bed subject to pressure and outside this region is interrupted by the partition or partitions.

Advantageously, the at least one partition may be fixedly or stationarily mounted, if it is known in advance what reel widths are to be wound. If a plurality of partitions are fixedly mounted, it is possible to wind a corresponding number of different reel widths.

Further, a partition may be located in the axial direction between every two orifices. This arrangement may permit virtually all reel widths to be wound. As soon as an orifice is located in the region of the winding bed that is subject to pressure, it is likewise placed under pressure. However, the compressed air cannot escape through the adjacent orifice, which is located outside the region subject to pressure, due to the arrangement of the partition.

It may be preferable to form the partitions with gripping plugs. The gripping plugs may be made from, e.g., a material comparable to rubber, and may be axially driven into the chamber. However, a certain outlay of energy, which can be made available during manufacture, may be necessary for this. As soon as the plugs have been placed at their specified location, they grip tightly with a gripping force adequate to resist the forces occurring in the winding bed from the compressed air. The grip connection does not have to be absolutely airtight, i.e., the seal between the plugs and the wall of the chamber must merely be adequate to ensure that the pressure necessary in the winding bed for the weight relief of the reel is maintained.

In an alternative or additional embodiment, at least one partition may be movable in the axial direction and lockable. In this case, it is possible to adjust the width of the zones which can be subjected to pressure. The partition merely has to be brought between the two orifices, which are located inside and outside an axial boundary of the pressurized zone of the winding bed. In this case, it is possible to make the air gathering space inside the pressurized zone relatively large, i.e., pressure equalization between adjacent air gathering spaces is not hindered by the partitions.

Further, two partitions may be movable in opposite directions. If only two partitions are present, they may be moved symmetrically relative to axially symmetric planes. This simplifies the adjustment of reel widths, e.g., when only a single reel or axially adjacent reels are wound.

A plurality of orifices may be advantageously positioned one behind another in the circumferential direction and may open into the same air gathering space. This embodiment can also be used without necessitating subdividing of the chamber in the axial direction. If a plurality of orifices are available, then either the usable cross-section through which air can be deflected is increased or the individual cross-sections of the orifices may be made smaller, such that the danger of marking the material web to be wound is even lower.

Here, it is preferable that the orifices opening into the same air gathering space have a smaller distance between them in the circumferential direction than two orifices which open into an adjacent air gathering space in the circumferential direction. Thus, the danger of developing a "short circuit", through which the pressure from the winding bed subject to pressure can escape, is kept low.

In a further embodiment, the air gathering space may be connected with an equalization space via at least one relief bore. In this way, it is possible to obtain even better adherence of the material web on the surface of the roll. Here, the term "relief bore" should not be construed as limited to being produced by a boring process, i.e., the relief bore may be generated in another manner.

The air adhering to the material web can penetrate through the orifice and channel into the air gathering space. While the resultant pressure increase is not excessively large, it is measurable. However, the higher pressure can be dissipated through the relief bore during the course of the continued rotation of the roll. In fact, the air can flow out through the relief bore into the equalization space. Because, when the material web is guided onto the surface of the roll, no further feeding of air occurs, the material web is applied to the surface of the roll in a very airtight and solid manner after a predefined time to dissipate the pressure, i.e., after a predefined angle of rotation of the roll. The placement is so solid and stable that a lateral drift of the material web on the surface of the roll virtually no longer occurs. When the surface of the roll enters a zone where the winding reel is supported by compressed air, i.e., in a discharge region, the compressed air may penetrate the orifices and enter the air gathering spaces to the relief bore. This results in an increase in pressure in the air gathering space that is significantly greater than from the air adhering to the material web. Further, the angle of rotation covered by the surface of the roll in the pressure zone is shorter so that some air can flow out through the relief bore into the equalization space, resulting in a tolerable loss. However, the pressure under the winding reel is not reduced to an extent which would make a significantly higher service pressure necessary. Thus, the advantages of a roll having a jacket that is completely perforated and which consequently cannot be used in connection with compressed air support can be combined with the advantages of a roll that is suitable for compressed air support. The compromise is that the cross-sectional area available for the outflow of air through the relief bore is significantly less than the total of the cross-sectional areas of the orifices.

Preferably, the equalization space is formed by an interior space surrounded by the jacket of the roll. This interior space is available with many rolls that are formed as hollow rolls. If the interior space is used as an equalization space, it may be possible to forego utilizing complicated conduits.

In this arrangement, the interior space may be coupled to the surrounding atmosphere so that it is possible to ensure that the same pressure in the surrounding atmosphere, i.e., atmospheric pressure, prevails in the interior space. This arrangement has the advantage that the interior space does not have to be subdivided into one zone which is adjacent to the pressure zone, i.e., the discharge zone, and one zone which is adjacent to the intake zone for the material web. Instead, compressed air is allowed to penetrate in small quantities into the interior space in the pressure region. Further, because the pressure can escape through the connection to the atmosphere, an increase in pressure does not occur. Accordingly, there is likewise no increase in pressure to result in a raising of the material web in the "intake region" of the reel winding roll.

Preferably, the air gathering space may be subdivided into a plurality of chambers in the axial direction and each chamber may have at least one relief bore. With this embodiment, an easier adaptation of the reel winding roll to various widths of the reels to be wound is obtained. Air from the compressed air support region cannot escape in the axial direction through the air gathering space. However, it is possible that, in the intake region, the air adhering to the material web can flow into the equalization space.

The relief bore may be formed as a throttle channel. The throttle channel may provide flow resistance to the air, which means that the air entrained by the material web, which results in a slight increase in pressure in the air gathering space, can flow out through the throttle. Since a relatively long time is available for this, i.e., the time during which the material web is in contact with the roll surface, which can be the case over angular sections on the order of between, e.g., approximately 120 and 180°, the material web can, at least at the end of this contact angle, lie very firmly on the surface of the roll. However, with the sudden increase in pressure, such as occurs with the entry of the corresponding surface region into the compressed air support zone, the throttle may generate a relatively large drop in pressure. Of course, air can also flow out of the air gathering space into the equalization space. Because of the relatively large pressure differential, the amount of air may be even greater than in the intake zone. However, it is still inadequate to cause an appreciable drop in pressure in the air gathering space. Accordingly, the pressure in the compressed air support zone is also not appreciably reduced, i.e., virtually no additional power is necessary to supply a relatively large amount of air into the compressed air support region.

Alternatively or additionally, the relief bore may be provided with a valve. This valve may be opened when a corresponding sector of the roll is in the intake zone, i.e., when air entrained by the material web is to flow out through the relief bore. In contrast, when the corresponding roll sector comes into the discharge region, where high pressure prevails due to the compressed air support, the valve may be closed so as to prevent the outflow of air.

This particular embodiment can be rather simply implemented if the valve is designed as a self-closing valve. As long as the pressure differential between the air gathering space and equalization space is small, the valve can remain open. This is the case in the intake region. In contrast, if the pressure differential becomes greater, which is the case when the corresponding air gathering space enters the discharge region, the valve may be closed. The valve can be designed, e.g., as a check valve which is held open by springs or other forces which cannot be overcome until there is a relatively high pressure differential.

Preferably, the air gathering space may be formed by a tube, which is disposed within an axial groove in the core, and the side walls of the axial groove may overlap the tube from the outside. Such a groove may be produced to have, e.g., a rectangular cross-section first produced by a milling cutter. Then, the grooves may be countersunk with a profile cutter. When the tube is then pushed into the groove, the tube may be securely held in the radial direction, i.e., against centrifugal force. This embodiment of the present invention may be relatively simple to implement and particularly reliable.

Preferably, the tube may substantially form a seal with the surface of the core. Thus, a virtually smooth surface of the roll may be obtained, onto which the elastic surface layer can be applied. The tiny grooves which remain between the tube and the surface of the core may be filled with coating material and, thereby, improve the adhesion between the surface layer and the core.

The amount of entrained to be taken into the air gathering space, and therefore the appropriate size for the air gathering space, may be determined with reference to the following. The nip height $s_{L,O}$, measured in meters, may be determined from the following equation:

$$S_{L,O} = 0.643 * r * \left[\frac{6 * \eta * (u_1 + u_2)}{T}\right]^{2/3}$$

in which η represents the viscosity of air [Pa*s] (which may be, e.g., approximately $1.8\times10^{-6}$ Pa*s); T represents the web tension [N/m]; r represents the radius of the cooling roll [m]; $u_1$ represents circumferential speed of the cooling roll [m/s]; and $u_2$ represents the speed of the paper web [m/s].

The centrifugal forces which act on the paper are directed against the radial components of the web tension. The action of the web tension on the air gap is thus reduced. In the above formulas for the nip height it is consequently necessary to use the resultant web tension T*:

$$T^* = T - Flg * u_{Web}^2$$

in which Flg represents the basis weight of the paper [kg/m$^2$]; and $u_{Web}$ represents the speed of the web [m/s]. Because of the porosity of the paper, air leaks out of the nip, which inevitably reduces the nip height. This reduction in nip height Δs [μm] may be determined from:

$$\Delta s = \frac{V_{por}}{600}\sqrt{\frac{1}{\Delta p_1} * T * r} * \frac{2 * \pi * \frac{\beta}{360^\circ}}{u} * 10^4$$

in which $V_{por}$ represents the porosity of the paper [ml/min]; $\Delta p_1$ represents overpressure in the measurement device [N/m$^2$] (approximately 1472 Pa)]; r represents the roll radius [m]; β represents the angle of wrap [degrees]; and u represents the web speed [m/s].

Lateral outflow of air also reduces the nip height. This reduced nip height so [m] may be determined by:

$$s_L = \frac{s_{L,O}}{\sqrt{1 + \frac{4 * T * s_0^2 * \varphi}{\eta * B^2 * 2 * u}}}$$

in which $s_{L,O}$ represents the maximum nip height (nip height at intake) [μm]; ϕ represents an angle coordinate [rad]; η represents the dynamic viscosity of the air [Pa*s]; and B represents web width [m].

Further calculations, e.g., for nip overpressure and volume flow rate in the air gap, are based on a roll width of one meter. In particular, nip pressure $P_{LS}$ [Pa] can be determined from the following:

$$P_{LS} = P_\infty + \frac{T^*}{r}$$

in which $P_\infty$ represents ambient pressure [Pa]. Further, volume flow rate in the air gap $V_{LS}$ can be determined from the following:

$$\dot{V}_{LS} s_L * u$$

$$V_{LS} = \frac{\dot{V}_{LS}}{n}$$

in which $\dot{V}_{LS}$ represents the nip volume flow rate [m$^3$/s]; $V_{LS}$ represents nip volume in one revolution [m$^3$]; and n represents rotational speed [1/s].

A necessary leak volume $V_2$ which the nip can accommodate in one revolution can be determined by the following:

$$\frac{P_\infty}{P_{LS}} = \left(\frac{V_2}{V_1}\right)^n$$

$$V_{LS} = V_1 - V_2$$

$$V_2 = V_{LS} * \left[\frac{1}{1 - \left(\frac{P_\infty}{P_{LS}}\right)^{\frac{1}{n}}} - 1\right]$$

in which $V_1$ represents leak volume [m$^3$] before the increase in pressure; $V_2$ represents leak volume [m$^3$] after the increase in pressure; and n represents polytropic exponent (defined here as 1.235).

Accordingly, the present invention is directed to a reel winding roll that includes a core, an elastic surface layer positioned on the core, surface orifices formed on the elastic surface layer, air gathering spaces that are sealed at least in the circumferential direction, and channels arranged to couple the surface orifices to the air gathering spaces.

In accordance with another feature of the present invention, a volume of the air gathering spaces is sufficient to receive air entrained by a web moving over the roll so as to result in an increase in pressure of less than approximately 50 mbar.

In accordance with another feature of the present invention, the air gathering spaces have a dimension in at least one of and axial and/or radial direction that is larger than the channel.

According to still another feature of the present invention, each of the air gathering spaces are composed of a plurality of air gathering spaces that are coupled to each other substantially in an axial direction.

In accordance with still another feature of the present invention, the surface orifices are arranged in a line that extends at a predefined angle to a line parallel to the axis.

In accordance with a further feature of the present invention, the air gathering spaces have a predefined minimum size in operation.

According to a still further feature of the present invention, the air gathering spaces have a substantially constant size in operation.

In accordance with another feature of the present invention, an insert that fits radially below the surface is provided, and the air gathering spaces are located within the insert. Further, the insert may be formed by the core. Alternatively, the insert may be formed by a tube arranged to run in a substantially axial direction. Still further, the core may be composed of a roll shell, and the insert may be formed as an integral part positioned inside a roll shell.

In accordance with a further feature of the present invention, the elastic layer may include at least two layers of material, and the air gathering spaces may be formed on a boundary between two layers of material.

According to still another feature of the present invention, blind bores may be formed on the surface layer.

In accordance with another feature of the present invention, a portion of surface layer that consists of the surface orifices or of the surface orifices and blind bores may be less than 15% of a total surface.

In accordance with a further feature of the present invention, each of the air gathering spaces may be composed of a chamber that continuously extends in an axial direction and that is closed at its axial ends. The chamber may include at least one partition to axially subdivide the air gathering space. Further, the at least one partition may be fixedly mounted. Further still, the at least one partition may be positioned between adjacent surface orifices. The at least one partition may be composed of gripping plugs. The at least one partition may be movable in an the axial direction and lockable in position. Further, the at least one partition may include at least two partitions that movable together in opposite directions.

According to a still further feature of the present invention, the surface orifices may include a plurality of orifices arranged in a circumferential direction and coupled to a same air gathering space. The plurality of orifices coupled to the same air gathering space may be spaced a shorter distance from each other than a distance between one of the plurality of orifices and an adjacent surface orifice coupled to another air gathering space.

In accordance with another feature of the present invention, an equalization space is provided, and the air gathering spaces may be connected to the equalization space via at least one relief bore. Further, the equalization space may be formed by an interior of the core, and the interior of the core may be coupled to a surrounding atmosphere. Further still, the air gathering spaces may be axially subdivided into a plurality of chambers, and each of the plurality of chambers may include at least one relief bore. Still further, the relief bore may be formed as a throttle channel. Moreover, a valve may be coupled to the relief bore. the valve may be composed of a self-closing valve.

In accordance with still another feature of the present invention, the core may be formed with axial grooves having sidewalls for receiving the air gathering spaces, the air gathering spaces may be formed by tubes positioned within the axial grooves, and the sidewalls may be dimensioned to extend beyond the upper extent of the tubes. Further, the tubes substantially form a seal with an outer surface of the core.

In accordance with a still further feature of the present invention, the surface orifices are aligned and oriented at an angle to a circumferential direction.

According to another feature of the present invention, the air gathering spaces are formed in the core, and the channels may extend completely through the elastic surface and partially through the core.

In accordance with another feature of the present invention, the air gathering spaces may be formed by tubes positioned within the core, and the channels may extend completely through the elastic surface and completely through the core.

In accordance with another feature of the present invention, the core may include a plurality of notches for receiving tubes, the air gathering spaces may be formed by the tubes, which are placed within the plurality of notches, and the elastic surface may include a plurality of notches to receive a portion of the tubes not received by the plurality of notches of the core. Further, the plurality of notches may include a bottom surface on which the tubes rest and sidewalls for receiving side portions of the tubes. Further still, the sidewall may be arranged to tangentially contact the side portions of the tubes at two positions, or the sidewalls may be arranged to tangentially contact the side portions of the tubes at one position. For example, the sidewall may be oriented substantially perpendicular to the bottom surface, or the sidewall may be oriented at an acute angle to the bottom surface.

In accordance with yet another feature of the present invention, the air gathering spaces may be formed within the elastic surface. Further, the air gathering spaces may be formed by a plurality of tubes, and the plurality of tubes may be arranged to rest on an outer surface of the core.

The present invention is also directed to a process for winding a reel on a winding bed that includes a reel winding roll having a core, an elastic surface layer positioned in the core, surface orifices formed on the elastic surface layer, air gathering spaces sealed in at least the circumferential direction, and channels arranged to couple the surface orifices to the air gathering spaces. The process includes guiding a moving web over a circumferential portion of the reel winding roll, and receiving, in the air gathering spaces, air entrained by the moving web. The entrained air is guided to the air gathering spaces through the surface orifices and the channels.

In accordance with another feature of the present invention, substantially no change of volume occurs in the air gathering spaces during a revolution of the reel winding roll.

According to still another feature of the present invention, the process further includes opening a valve between the air gathering spaces and an interior of the reel winding roll when a pressure within the air gathering spaces is excessive.

In accordance with yet another feature of the present invention, the process further includes coupling the air gathering spaces to an interior of the reel winding roll to lower a pressure within the air gathering space. Further, a pressure in the interior of the reel winding roll is the same as the atmospheric pressure outside of the reel winding roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is directed to winding a web, e.g., a paper web, to form a web reel. However, while the exemplary embodiment discusses a paper web, it is noted that this discussion is for the purposes of explanation and should not be construed as limiting. In fact, the features of the present invention can likewise be utilized with other material webs, e.g., cardboard, metal foils, plastic films, etc., to be wound. Moreover, the features of the present invention can also be practiced with textile webs if they are not air permeable or are only limitedly so.

Figure 1:
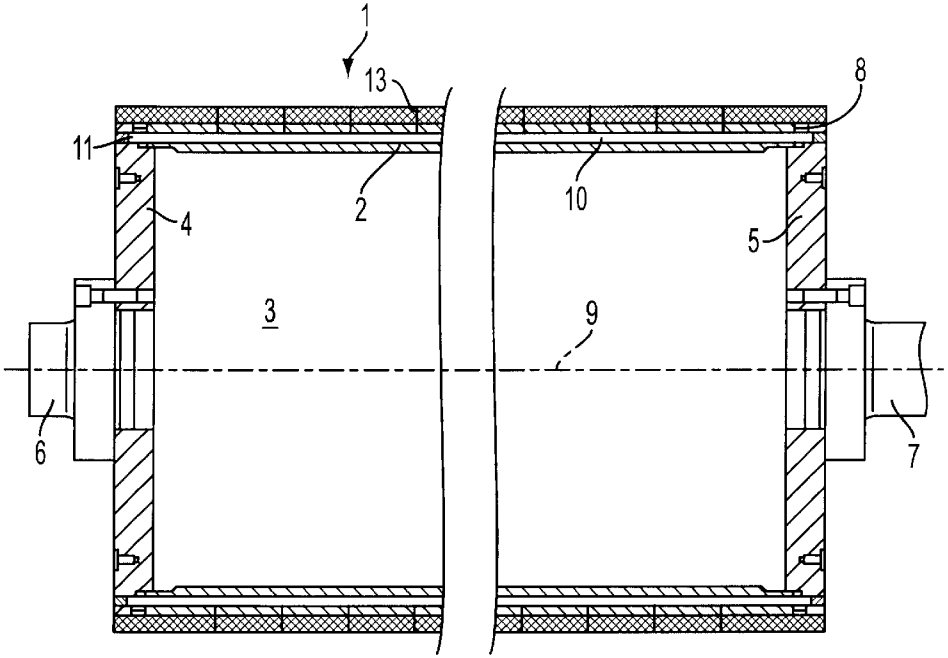
FIG. 1 illustrates a schematic longitudinal section through a reel winding roll.

FIG. 1 illustrates a roll 1 having a core 2 of, e.g., steel or cast iron, which is formed as a shell having a hollow interior 3.

Roll 1 may be utilized, e.g., as a carrying roll in a reel winding device in which two carrying rolls form a winding bed. Further, the winding bed can be pressurized with compressed air to provide weight relief of a reel being wound.

Figure 9:
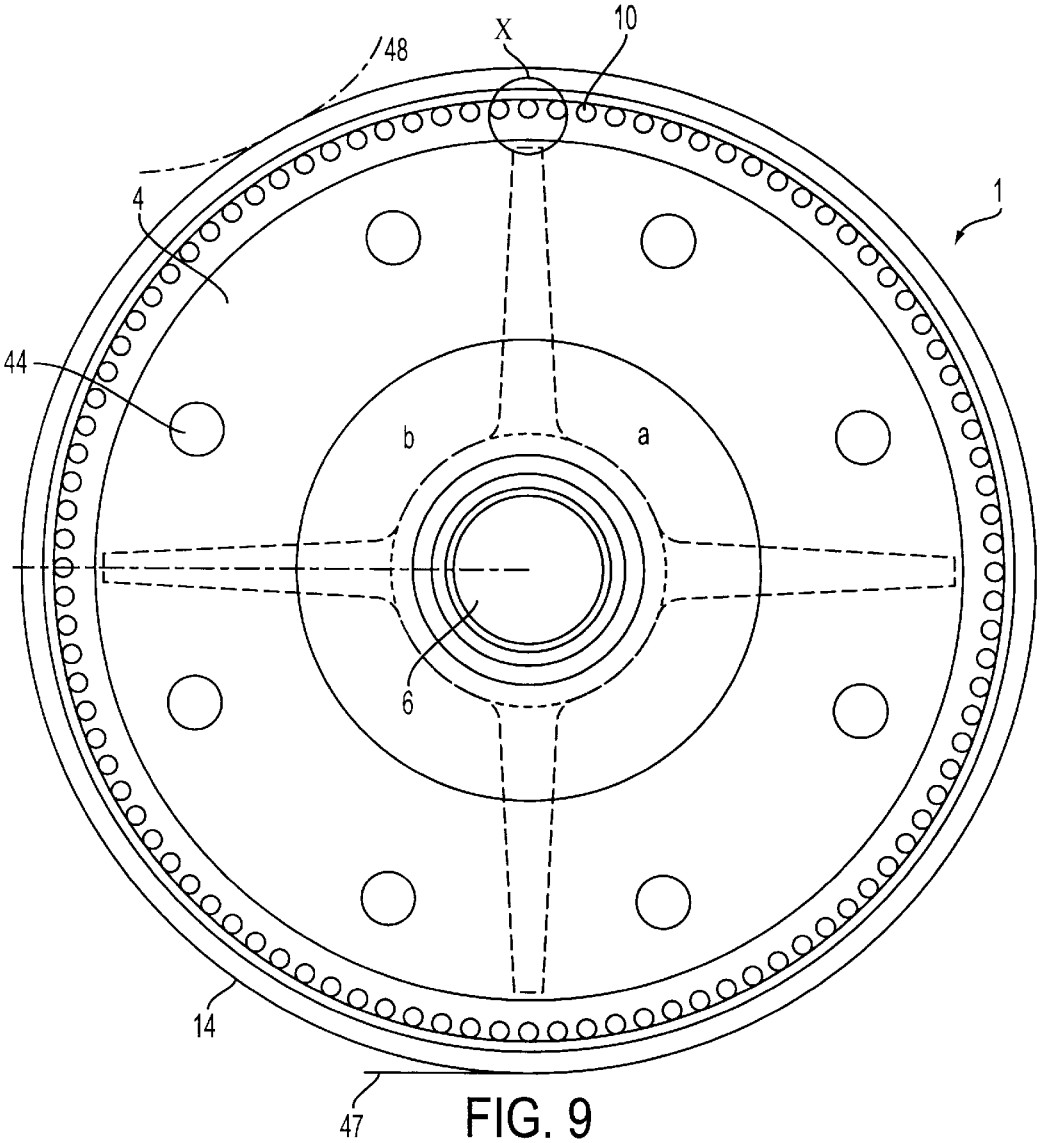
FIG. 9 illustrates an end view of the roll according to FIG. 8.

Interior 3 is closed on both ends by covers 4 and 5, and roll journals 6 and 7 are attached to covers 4 and 5, respectively. FIG. 9 illustrates, e.g., an end view of roll 1 and its cover 4.

An elastic layer 8, which can be made of, e.g., rubber or a comparable elastomer, may be located on the exterior of core 2.

Core 2 is bored peripherally, i.e., a large number of bores 10 may be arranged to run in the axial direction, and, further, may be arranged substantially parallel to axial direction 9. Bores 10 may also be located to penetrate covers 4 and 5, and may be sealed on their ends with plugs 11. Bores 10 may have a diameter of, e.g., approximately 10 mm.

Orifices 12 are provided in the elastic layer 8, and each orifice 12 is coupled with bore 10 through a channel 13. Accordingly, air from the surface 14 (see FIG. 3) of layer 8 can be guided through channel 13 into bore 10 and back via orifices 12. Thus, bore 10 forms an air gathering space, and channel 13 may have a diameter on the order of, e.g., approximately 3 to 4 mm.

During insertion in a reel winder, when a material web is being guided around roll 1, which is arranged as a carrying roll, air adhering to the material web (i.e., entrained air) can be guided through orifices 12 and corresponding channels 13 into bores 10, i.e., the air gathering spaces, by the web itself. Moreover, at the same time, protection may provided against creation of a short circuit for compressed air around the circumference of roll 1 so that roll 1 may be utilized in conjunction with compressed air relief of the reel winder. The compressed air may be forced into the air gathering spaces 10. However, the air forced into air gathering spaces 10 cannot flow any farther since air gathering spaces 10 are sealed in the circumferential direction.

As an alternative to arranging bores 10 parallel to axial direction 9, bores 10 may be arranged to have a slight angular deviation relative to axial direction 9. The angular deviation may be limited such that no short circuit between a pressure region in the winding bed and a region outside it is created.

The size of bore 10, and, therefore, the size of the respective air gathering space, for accommodating the air is selected such that no relatively great elevation in pressure occurs due to the adhering air during intake of the material web. The pressure elevation in bore 10 remains, e.g., less than approximately 50 mbar, and preferably, a maximum of approximately 10 mbar.

Figure 3:
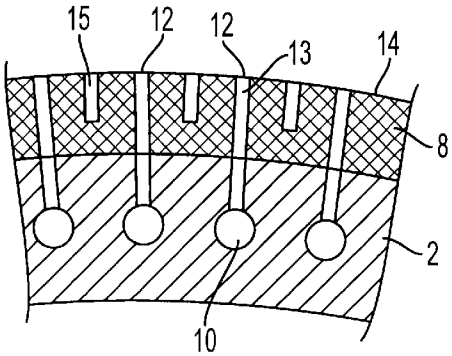
FIG. 3 illustrates an enlarged detail of FIG. 2.

Moreover, blind bores 15, which may result in a slight modification, e.g., a softening, of layer 8 may be provided in layer 8, as illustrated in FIG. 3. The sum of the areas of the orifices 12 and of the blind bores 15 in surface 14 have a share of, e.g., less than approximately 15%, and preferably between approximately 10 and 15%. Thus, the elastic characteristic of layer 8 is not appreciably altered by orifices 12 and/or blind bores 15. Further, with this arrangement, the danger that orifices 12 and/or blind bores 15 might cause marking of the material web remains low. Further, layer 8 is so stable that the cross-section of channel 13 always remains open. Thus, channel 13 and bores 10 (if bores 10 are located within layer 8) are never completely filled with displaced material of elastic layer 8.

Figure 2:
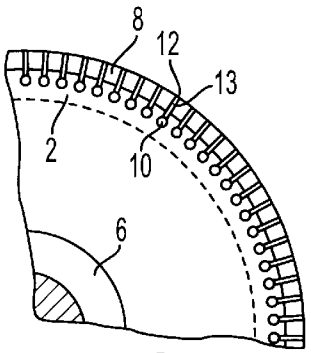
FIG. 2 illustrates a portion of a cross-section of the roll according to FIG. 1.
Figure 4:
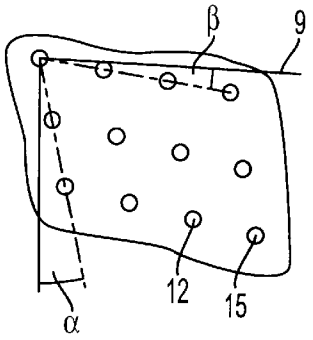
FIG. 4 illustrates a detail of a top view of the surface of the roll.

As discussed above, and as shown in FIG. 4, it is not necessary to arrange orifices 12 and blind bores 15 to lie exactly one after another in the circumferential direction and/or to lie next to each other exactly parallel to axial direction 9. Instead, orifices 12 and/or orifices 12 and blind bores 15 may be aligned to form small angles $\alpha$ and $\beta$ with respect to the circumferential direction and the axial direction, respectively. It is noted that the angles $\alpha$ and $\beta$ as shown in FIG. 4 have been depicted as exaggeratedly large for the purposes of clarity and discussion. These angles in practice need only to be large enough that not all orifices 12 and/or blind bores 15 of a same row are simultaneously brought into contact with the material web.

FIGS. 5A–5H depict several alternative for arranging the air gathering spaces, orifices 12, and channels 13 relative to each other. For the sake of clarity, blind bores 15 have been omitted, however, in practice, these may also be provided, e.g., in the manner discussed with reference to FIG. 3.

Figure 5A:
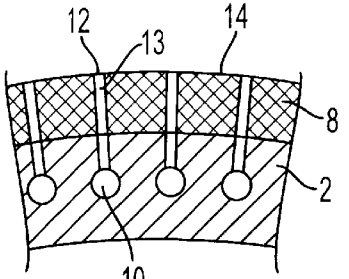
FIGS. 5A–5H illustrate various embodiments in the view according to FIG. 3.

FIG. 5A illustrates an arrangement similar to that depicted in FIG. 3. Bores 10 may be provided in core 2 to form the air gathering space. Bores 10 may be coupled with orifices 12 on surface 14 via channels 13, which pass through both elastic layer 8 and a portion of core 2.

Figure 5B:
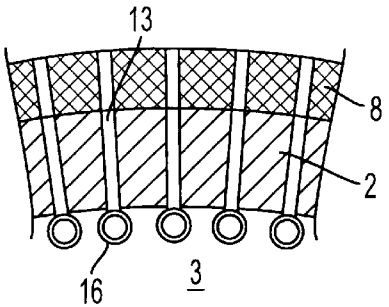

As shown in FIG. 5B, channels 13 run, not only through the entire surface layer 8, but also through the thickness of core 2. Tubes 16, which form the air gathering spaces, may be arranged on interior 3 of core 2.

Figure 5C:
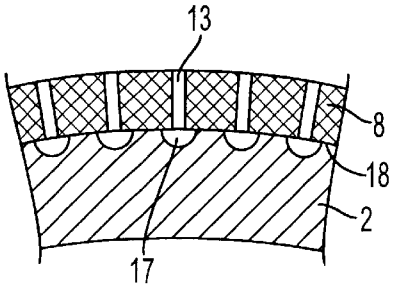

In FIG. 5C, the air gathering spaces may be formed by axial grooves 17, which may be axial grooves having, e.g., a semicircular cross-section, that are located in the radially outermost surface of core 2. Channels 13 may be arranged to pass through the elastic layer and open into grooves 17. A sealing tape 18, which is provided to substantially prevent air from being forced into a contact region between elastic layer 8 and core 2, may be arranged between elastic layer 8 and core 2.

Figure 5D:
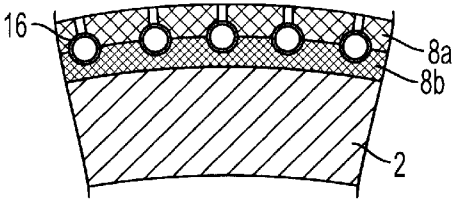

In FIG. 5D, tubes 16 may be located within the elastic layer, which may be formed of, e.g., a radially outermost layer 8*a* made of a softer material, e.g., softer rubber, and a radially innermost layer 8*b* made of a harder material, e.g., harder rubber. Here, tubes 16 are arranged within the contact region between layers 8*a* and 8*b*.

Figure 5E:
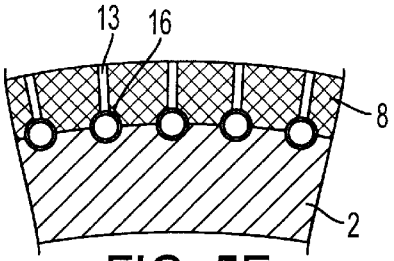

FIG. 5E depicts a similar embodiment with a single-ply layer 8. In this alternative embodiment, tubes 16 may be located on the boundary between core 2 and layer 8.

Figure 5F:
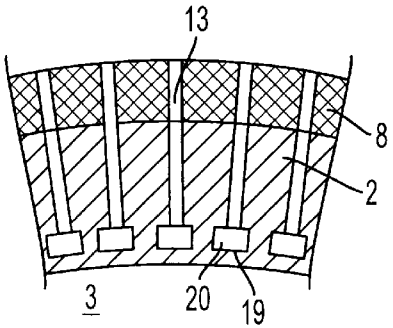

FIG. 5F illustrates an embodiment in which channels 13 pass completely through layer 8 and core 2. An insert 19, which may be provided with grooves 20 on its radial exterior, may be located in interior (or cavity) 3. Grooves 20 may run substantially in the axial direction, and insert 19 may be arranged to press with a certain initial tension against the inside of core 2. Thus, grooves 20 form the air gathering spaces.

Figure 5G:
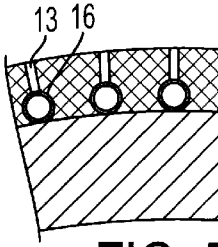

In the embodiment according to FIG. 5G, tubes 16 may be arranged in layer 8, however, in this embodiment, tubes 16 may be located completely inside layer 8, and may be positioned adjacent to the boundary with core 2. As a further alternative, it may also be possible to shift tubes 16 farther radially outwardly from core 2.

Figure 5H:
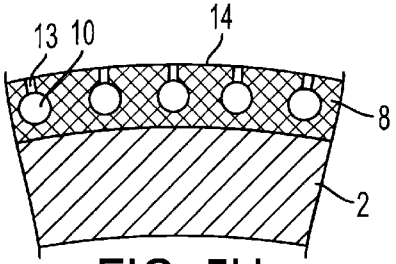

FIG. 5H depicts an alternative exemplary embodiment which provides, without stabilizing measures, to keep the volume of bores 10 constant. Of course, while there may be a little deformation during operation due to the elasticity of layer 8, this is not critical since it does not occur until after the material web is already in position on surface 14 of roll 1. In other words, the critical air bubble has already been eliminated.

The rolls depicted in FIGS. 5A–5H can be used both with and without compressed air relief. In all cases, the material web lies smoothly on the surface 14 of roll 1.

Figure 6:
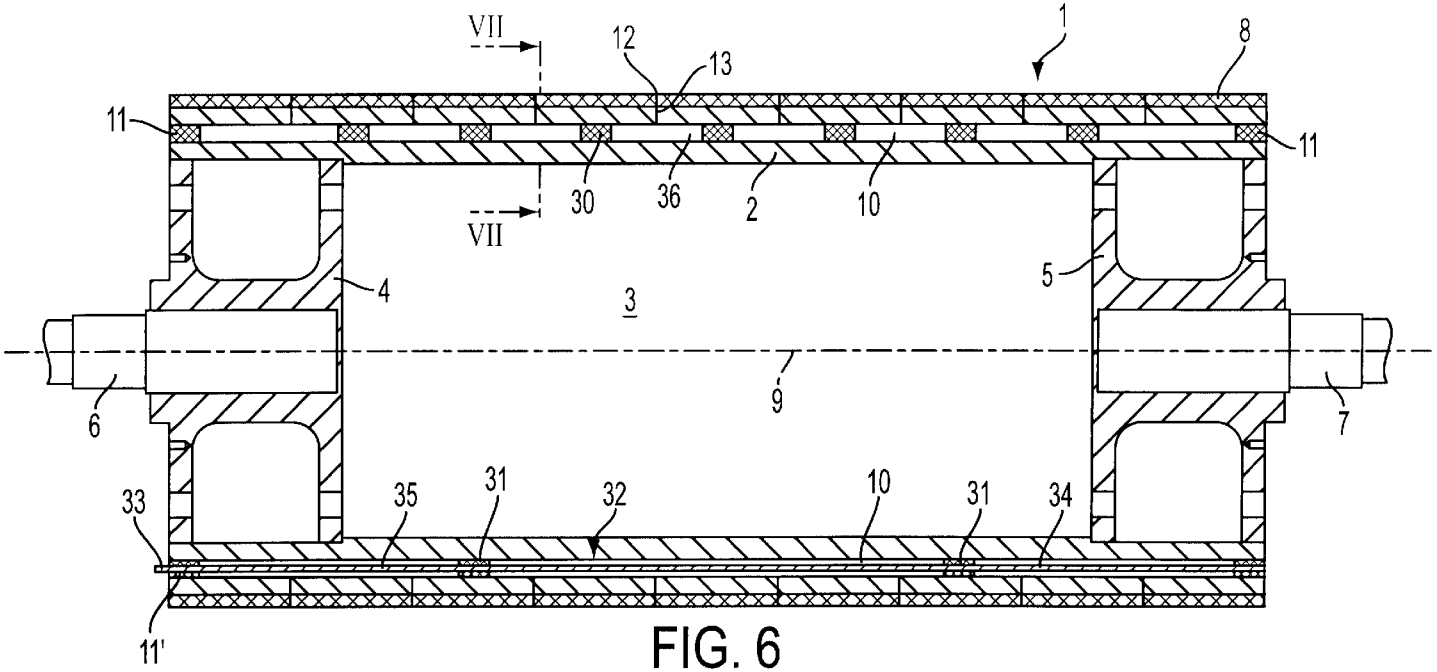
FIG. 6 illustrates another roll with two different designs of air gathering spaces.

As illustrated in FIG. 6, bore 10 forms a chamber, which may be axially subdivided by a plurality of partitions 30 and 31 to form a plurality of air gathering spaces inside bore 10. Further, as shown in FIG. 6, partitions 30 and 31 depict two different possibilities for subdividing bore 10 into a plurality of air gathering spaces in the axial direction.

As illustrated in the top half of FIG. 6, partitions 30 may be composed of gripping plugs. For example, one partition 30 may be disposed between adjacent channels 13 so that air, which arrives through one channel 13 into a respective air gathering space 36, can escape only through the same channel 13, and not through adjacent channels 13. In this manner, a short circuit is avoided, which would have negative effects, e.g., if a reel or a horizontal batch of reels adjacent to each other were wound, whose axial length were less than the axial length of roll 1. In such a case, it would be possible for the compressed air supplied to the winding bed to enter through a centrally disposed channel 13 and move axially outwardly through bore 10 to escape through another channel 13 that lies outside a scaled zone in which the compressed air is supplied to the reel.

Because of the fact that a large number of partitions 30 may be used, i.e., each channel 13 may be assigned or associated with its own air gathering space 36, the present invention provides extraordinary flexibility in the selection of the reel width to be wound.

As illustrated in the bottom half of FIG. 6, two partitions 31, which are axially movable in bore 10, are shown. Partitions 31 may be located on a threaded spindle 32, e.g., having a right-hand thread 34 on the right and a left-hand thread 35 on the left. When an actuator 33, which extends through plugs 11' located at the axial ends of bore 10, is rotated, partitions 31 are driven to axially move in opposite directions, yet symmetrically to plane in the axial center of roll 1. This design may be particularly advantageous if the reel is always placed centrally on roll 1. By shifting the position of partitions 3 1 via threaded spindle 32, the width of the zone supplied with pressure can be adapted to the width of the reel.

Obviously, only one of the two depicted embodiments of FIG. 6 would be used in a same roll.

Figure 7:
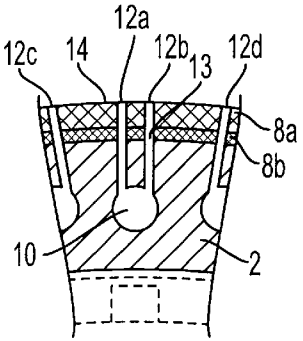
FIG. 7 illustrates a schematic cross-sectional view VII—VII according to FIG. 6.

As illustrated in FIG. 7, a plurality of channels 13, e.g., two channels, may be successively arranged one after the other in the circumferential direction to open into the same bore 10. Accordingly, orifices 12*a* and 12*b* in surface 14 may be coupled to the same bore 10. Adjacent orifices 12*c* and 12*d* may be coupled to other bores. A distance between orifices 12*a* and 12*b*, which are connected to the same bore 10, may be less in the circumferential direction than the distance between two adjacent orifices 12*a* and 12*c* or 12*b* and 12*d*, which open into different bores 10. By design, it is possible either to enlarge the flow cross-section, so that the air arrives in the bore 10 with still less resistance, or to keep the cross-section of each individual orifice 12*a* and 12*b* small to further reduce marking sensitivity.

Figure 10:
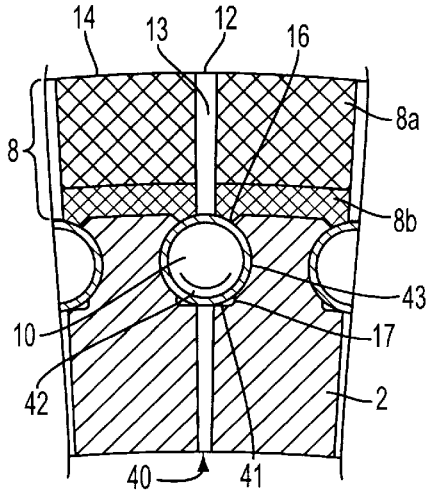
FIG. 10 illustrates a detail X of FIG. 9.

In the exemplary embodiment according to FIG. 10, core 2 may include a large number of axial grooves 17 uniformly distributed on its radially outward surface in the circumferential direction. Grooves 17 may, e.g., be milled, and may have a rectangular cross-section. After making the rectangular grooves, a spherical cutter may be utilized to produce convex or bulging walls 43, to produce a cross-section of grooves 17 that is substantially circular.

A tube 16, made of, e.g., brass, may be positioned in each groove 17 to lie on the bottom of the groove and to be overlapped by the side walls of the grooves from the outside. Tube 16 may be inserted simply by being pushed into groove 17 from one end of roll 1.

The depth of grooves 17 must be selected such that the outer surface of tube 16 virtually forms a seal with the surface of core 2. Thus, on the uncoated roll, only narrow grooves remain on both sides of tube 16, which may be closed by applying layer 8. However, the narrow grooves have no negative effects on the uniformity of layer 8.

Figure 8:
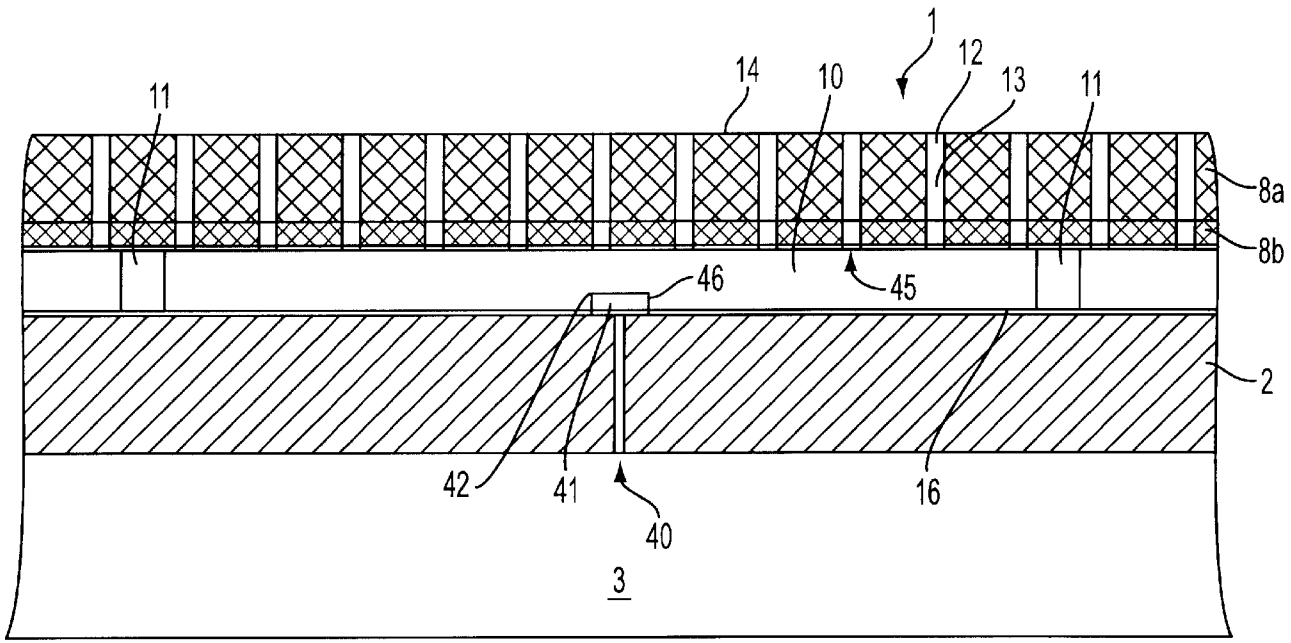
FIG. 8 illustrates a detail of another roll in radial cross-section.

As shown in FIG. 8, orifices 12 are provided in elastic layer 8, and each orifice 12 may be coupled connected via a channel 13 and a bore 45 in the wall of tube 16 with an air gathering space 10, which is formed by the interior of tube 16. A plurality of plugs 11, which axially subdivide the air gathering space 10 into a plurality of sections or chambers, may be axially distributed in the interior of tube 16. While tube 16 may have an inside diameter on the order of, e.g., approximately 10 mm, channel 13 may have a diameter on the order of, e.g., approximately 3 to 4 mm.

Interior 3 of roll 1 may be coupled with the interior of tube 16 via a relief bore 40, which passes through core 2. Tube 16 may also include a corresponding bore 46, which may be closed by a valve formed by a plate 41 that is held by springs 42 at a specific distance from the inside wall of tube 16. This valve is provided to be normally open. However, if a somewhat higher pressure differential between the interior of tube 16, i.e., air gathering space 10, and interior 3 occurs, plate 41 may be pressed against the inside wall of tube 16 to close relief bore 40.

Relief bore 40 may be designed as a throttle to provide a certain resistance against air flowing therethrough. Thus, in many cases, valve 41, 42 may not even be necessary.

When roll 1 is used in a reel winder, a material web 47 is guided onto roll 1, as depicted in FIG. 9, and is wrapped around roll 1 over an angle of, e.g., greater than approximately 180° and is then wound onto a reel 48. The region in which material web 47 is in contact with roll 1 may be referred to as an "intake region" a. To maintain contact pressure of the increasingly larger reel 48 on roll 1 from becoming too great, in a so-called "discharge region" b, which runs over a significantly smaller angle, a compressed air support may be provided, such that higher air pressure may be generated in space bounded by roll 1, reel 48, and other elements not depicted in detail.

During the feeding of material web 47, air adheres to it, which can initially prevent smooth and tight placement of material web 47 on surface 14 of roll 1. However, in accordance with the present invention, the entrained air can penetrate through orifices 12 and channels 13 into air gathering space 10. In this manner, the pressure increase may be relatively slight. Since the material web lies on the surface of roll 1 for a relatively long time, pressure equalization with interior 3 can occur in each air gathering space 10 via relief bores 40. Since no air feed occurs during contact of material web 47 on the surface of roll 1, after a certain angle of rotation of roll 1, all or virtually all air is actually trapped between material web 47 and surface 14 of roll 1. Material web 47 may then adhere relatively firmly to roll 1 so that drift can be avoided.

When the roll rotates farther, orifices 12 enter discharge region b, where the correspondingly higher pressure prevails. Of course, this higher air pressure may be propagated into air gathering space 10. However, because of the higher pressure differential between air gathering space 10 and interior 3 of roll 1, valve 41, 42 may close so that the air cannot flow into interior 3. Thus, no pressure loss occurs in discharge region b.

Even if there is no valve 41, 42, the pressure loss may be negligibly low. That is, because of its flow resistance, the amount of air flowing out of relief bore 40 remains relatively small. In fact, substantially no air flows out.

Orifices 44, by which interior 3 is connected to the surrounding atmosphere, may be provided in covers 4 to keep the air flowing out from resulting in an increase in pressure in interior 3 of roll 1.

Figure 13:
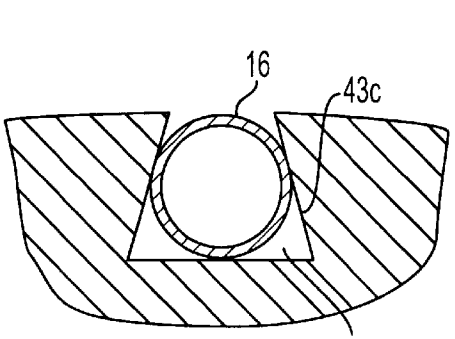
FIGS. 11–13 illustrates various groove shapes in accordance with the present invention.
Figure 12:
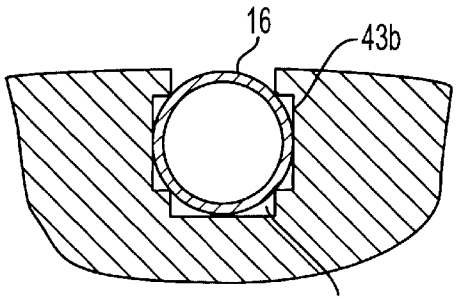
Figure 11:
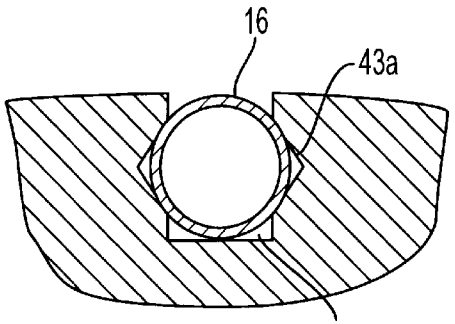

The cross-section of axial grooves 17 may also be shaped differently than that depicted in FIG. 10. Thus, in the ease of axial groove 17*a* shown in FIG. 11, arched walls 43 may be replaced by pairs of tangentially running walls 43*a*. Alternatively, axial groove 17*b*, illustrated in FIG. 12, may include side walls having a recess with base planes 43*b* parallel to each other. In a further alternative embodiment, axial groove 17*c*, shown in FIG. 13, may have a trapezoidal cross-section with correspondingly oblique side walls 43*c*. In all cases, tube 16 is positioned to sit on the base of the groove and is in contact with at least a portion of the wall of the groove so that at least two points of contact occur to provide a secure locking of tube 16 in the groove. Axial grooves 17 may be produced, e.g., by initially milling a rectangular groove and then producing the precise groove shape using a profile cutter.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A reel winding roll comprising:

a core;

an elastic surface layer positioned on the core;

surface orifices being formed on the elastic surface layer;

air gathering spaces extending in an essentially axial direction that are sealed from each other in at least in the circumferential direction; and channels arranged to couple the surface orifices to the air gathering spaces.

2. The roll according to claim 1, wherein a volume of the air gathering spaces is sufficient to receive air entrained by a web moving over the roll so as to result in an increase in pressure of less than approximately 50 mbar.

3. The roll according to claim 1, the air gathering spaces having a dimension in at least one of an axial and a radial direction that is larger than the channel.

4. The roll according to claim 1, each of the air gathering spaces being composed of a plurality of air gathering spaces that are coupled to each other substantially in an axial direction.

5. The roll according to claim 1, the surface orifices being arranged in a line that extends at a predefined angle to a line parallel to an axis of the core.

6. The roll according to claim 1, wherein the air gathering spaces have a predefined size in operation.

7. The roll according to claim 1, wherein the air gathering spaces have a substantially constant size in operation.

8. The roll according to claim 1, further comprising an insert that fits radially below the surface; and the air gathering spaces being located within the insert.

9. The roll according to claim 8, the insert being formed by the core.

10. The roll according to claim 8, the insert being formed by a tube arranged to run in a substantially axial direction.

11. The roll according to claim 8, the core being composed of a roll shell; and the insert being formed as an integral part positioned inside the roll shell.

12. The roll according to claim 1, the elastic layer comprising at least two layers of material; and the air gathering spaces being formed on a boundary between two layers of material.

13. The roll according to claim 1, further comprising blind bores being formed on the surface layer.

14. The roll according to claim 1, wherein a portion of surface layer that consists of the surface orifices is less than 15% of a total surface.

15. The roll according to claim 1, each of the air gathering spaces is composed of a chamber that continuously extends in an axial direction and that is closed at its axial ends;

the chamber including at least one partition to axially subdivide the air gathering space.

16. The roll according to claim 15, the at least one partition being fixedly mounted.

17. The roll according to claim 15, the at least one partition being positioned between adjacent surface orifices.

18. The roll according to claim 15, the surface orifices comprising a plurality of orifices arranged in a circumferential direction and coupled to a same air gathering space.

19. The roll according to claim 18, the plurality of orifices coupled to the same air gathering space being spaced a shorter distance from each other than a distance between one of the plurality of orifices and an adjacent surface orifice coupled to another air gathering space.

20. The roll according to claim 1, further comprising an equalization space; and the air gathering spaces being connected to the equalization space via at least one relief bore.

21. The roll according to claim 20, the air gathering spaces being axially subdivided into a plurality of individual chambers; and each of the plurality of chambers includes at least one relief bore.

22. The roll according to claim 20, the core being formed with axial grooves having sidewalls for receiving the air gathering spaces;

the air gathering spaces being formed by tubes positioned within the axial grooves; and the sidewalls being dimensioned to extend beyond the upper extent of the tubes.

23. The roll according to claim 22, the tubes substantially forming a seal with an outer surface of the core.

24. The roll according to claim 1, the surface orifices being aligned and oriented at an angle to a circumferential direction.

25. The roll according to claim 1, the air gathering spaces being formed in the core; and the channels extending completely through the elastic surface and partially through the core.

26. The roll according to claim 1, the air gathering spaces being formed by tubes positioned within the core; and the channels extending completely through the elastic surface and completely through the core.

27. The roll according to claim 1, the air gathering spaces being formed within the elastic surface.

28. The roll according to claim 27, the air gathering spaces being formed by a plurality of tubes; and the plurality of tubes being arranged to rest on an outer surface of the core.

29. The reel winding roll according to claim 1, wherein the air gathering spaces are circumferentially spaced around an axis of the core, and wherein each air gathering space is coupled to a plurality of axially spaced surface orifices.

30. A reel winding roll comprising:

a core;

an elastic surface layer positioned on the core;

surface orifices being formed on the elastic surface layer;

air gathering spaces that are sealed at least in the circumferential direction;

channels arranged to couple the surface orifices to the air gathering spaces;

each of the air gathering spaces being composed of a chamber that continuously extends in an axial direction and that is closed at its axial ends;

the chamber including at least one partition to axially subdivide the air gathering space; and the at least one partition being composed of gripping plugs.

31. A reel winding roll comprising:

a core;

an elastic surface layer positioned on the core;

surface orifices being formed on the elastic surface layer;

air gathering spaces that are sealed at least in the circumferential direction;

channels arranged to couple the surface orifices to the air gathering spaces;

each of the air gathering spaces being composed of a chamber that continuously extends in an axial direction and that is closed at its axial ends;

the chamber including at least one partition to axially subdivide the air gathering space; and the at least one partition being movable in an axial direction and lockable in position.

32. The roll according to claim 31, the at least one partition comprising at least two partitions that are movable together in opposite directions.

33. A reel winding roll comprising:

a core;

an elastic surface layer positioned on the core;

surface orifices being formed on the elastic surface layer;

air gathering spaces that are sealed at least in the circumferential direction;

channels arranged to couple the surface orifices to the air gathering spaces;

an equalization space;

the air gathering spaces being connected to the equalization space via at least one relief bore; and the equalization space being formed by an interior of the core.

34. The roll according to claim 33, the interior of the core being coupled to a surrounding atmosphere.

35. A reel winding roll comprising:

a core;

an elastic surface layer positioned on the core;

surface orifices being formed on the elastic surface layer;

air gathering spaces that are sealed at least in the circumferential direction;

channels arranged to couple the surface orifices to the air gathering spaces;

an equalization space;

the air gathering spaces being connected to the equalization space via at least one relief bore; and the relief bore being formed as a throttle channel.

36. A reel winding roll comprising:

a core;

an elastic surface layer positioned on the core;

surface orifices being formed on the elastic surface layer;

air gathering spaces that are sealed at least in the circumferential direction;

channels arranged to couple the surface orifices to the air gathering spaces;

an equalization space;

the air gathering spaces being connected to the equalization space via at least one relief bore; and a valve coupled to the relief bore.

37. The roll according to claim 36, the valve being composed of a self-closing valve.

38. A reel winding roll comprising:

a core;

an elastic surface layer positioned on the core;

surface orifices being formed on the elastic surface layer;

air gathering spaces that are sealed at least in the circumferential direction;

channels arranged to couple the surface orifices to the air gathering spaces;

the core including a plurality of notches for receiving tubes;

the air gathering spaces being formed by the tubes, which are placed within the plurality of notches; and the elastic surface including a plurality of notches to receive a portion of the tubes not received by the plurality of notches of the core.

39. The roll according to claim 38, the plurality of notches comprising a bottom surface on which the tubes rest and sidewalls for receiving side portions of the tubes.

40. The roll according to claim 39, the sidewall being arranged to tangentially contact the side portions of the tubes at two positions.

41. The roll according to claim 39, the sidewalls being arranged to tangentially contact the side portions of the tubes at one position.

42. The roll according to claim 41, the sidewall being oriented substantially perpendicular to the bottom surface.

43. The roll according to claim 41, the sidewall being oriented at an acute angle to the bottom surface.

44. A process for winding a reel on a winding bed that includes a reel winding roll having a core, an elastic surface layer positioned in the core, surface orifices formed on the elastic surface layer, air gathering spaces that extend in an essentially axial direction and that are sealed from each other in at the least the circumferential direction, and channels arranged to couple the surface orifices to the air gathering spaces, the process comprising:

guiding a moving web over a circumferential portion of the reel winding roll;

receiving, in the air gathering spaces, air entrained by the moving web, whereby the entrained air is guided into air gathering spaces, which extend in an essentially axial direction and which are circumferentially spaced and sealed from each other, through the surface orifices and their respective channels.

45. The process according to claim 44, wherein substantially no change of volume occurs in the air gathering spaces during a revolution of the reel winding roll.

46. The process according to claim 44, further comprising:

coupling the air gathering spaces to an interior of the reel winding roll to lower a pressure within the air gathering space.

47. The process according to claim 46, wherein a pressure in the interior of the reel winding roll is the same as the atmospheric pressure outside of the reel winding roll.

48. The process according to claim 44, wherein the entrained air guided into each air gathering space escapes only through the axially spaced surface orifices coupled to the air gathering space.

49. A process for winding a reel on a winding bed that includes a reel winding roll having a core, an elastic surface layer positioned in the core, surface orifices formed on the elastic surface layer, air gathering spaces sealed in at the least the circumferential direction, and channels arranged to couple the surface orifices to the air gathering spaces, the process comprising:

guiding a moving web over a circumferential portion of the reel winding roll;

receiving, in the air gathering spaces, air entrained by the moving web, whereby the entrained air is guided to the air gathering spaces through the surface orifices and the channels; and opening a valve between the air gathering spaces and an interior of the reel winding roll when a pressure within the air gathering spaces is excessive.

50. A reel winding roll comprising:

a cylindrical hollow core having a longitudinal axis;

an elastic roll jacket positioned on said core;

surface orifices being formed on a surface of said elastic roll jacket;

air gathering spaces being located within at least one of said roll jacket and said core, being arranged to extend in a substantially axial direction of said at least one of said roll jacket and said core, and being circumferentially spaced around the longitudinal axis; and channels arranged to couple the surface orifices to the air gathering spaces, wherein circumferentially adjacent air gathering spaces are sealed from each other.

51. The reel winding roll in accordance with claim 50, wherein said air gathering spaces comprise periphery bores in said roll jacket.

52. The reel winding roll in accordance with claim 50, wherein said air gathering spaces comprise periphery bores in said core.

53. The reel winding roll in accordance with claim 50, wherein said air gathering spaces comprise inlaid tubes in said roll jacket.

54. The reel winding roll in accordance with claim 50, wherein said air gathering spaces comprise inlaid tubes in a border region so that said air gathering spaces are coupled between said roll jacket and said core.

55. The reel winding roll in accordance with claim 50, wherein said roll jacket comprises an inner and an outer layer, and wherein said air gathering spaces comprise inlaid tubes in a border region so that said air gathering spaces are coupled between said inner layer and said outer layer.

56. The reel winding roll in accordance with claim 50, wherein said air gathering spaces comprise grooves in said core, and wherein said grooves are covered by said roll jacket.

57. A reel winding roll comprising:

a core;

an elastic surface layer positioned on the core;

surface orifices being formed on the elastic surface layer;

air gathering spaces being positioned to extend substantially parallel to each other from a first axial end to a second axial end of said reel winding roll, and being arranged to be sealed from each other in at least a circumferential direction; and channels arranged to couple the surface orifices to the air gathering spaces.

58. The reel winding roll according to claim 57, wherein said air gathering spaces are positioned to be substantially parallel to a longitudinal axis.

59. The reel winding roll according to claim 57, wherein said air gathering spaces are positioned to be oriented obliquely to a longitudinal axis.

* * * * *